US011717129B2

(12) United States Patent
Finison

(10) Patent No.: US 11,717,129 B2
(45) Date of Patent: Aug. 8, 2023

(54) DOCKING STATION WITH UNDERCARRIAGE CLEANING FUNCTIONALITY FOR FLOOR CLEANING MACHINE

(71) Applicant: Ecolab USA Inc., Saint Paul, MN (US)

(72) Inventor: Jeremy Finison, Rural Hall, NC (US)

(73) Assignee: Ecolab USA Inc., Saint Paul, MN (US)

( * ) Notice: Subject to any disclaimer, the term of this patent is extended or adjusted under 35 U.S.C. 154(b) by 120 days.

(21) Appl. No.: 17/208,314

(22) Filed: Mar. 22, 2021

(65) Prior Publication Data

US 2021/0290025 A1 Sep. 23, 2021

Related U.S. Application Data

(60) Provisional application No. 62/993,031, filed on Mar. 22, 2020.

(51) Int. Cl.
*A47L 11/40* (2006.01)
*A47L 11/29* (2006.01)

(52) U.S. Cl.
CPC ..... *A47L 11/4091* (2013.01); *A47L 11/29* (2013.01); *A47L 11/4005* (2013.01)

(58) Field of Classification Search
CPC .. A47L 11/4091; A47L 11/29; A47L 11/4005; A47L 2201/02; A47L 2201/026
USPC ..... 15/49.1, 319, 320
See application file for complete search history.

(56) References Cited

U.S. PATENT DOCUMENTS 7,779,504 B2 8/2010 Lee et al.
7,861,366 B2 1/2011 Hahm et al.
9,008,835 B2 4/2015 Dubrovsky et al.
9,138,115 B2 9/2015 Stryker et al.
9,717,388 B2 8/2017 Jeong et al.
9,788,698 B2 10/2017 Morin et al.
9,943,203 B2 4/2018 Samuels et al.
10,383,499 B2 8/2019 Fox et al.
11,199,853 B1 * 12/2021 Afrouzi ..... G05D 1/0246
(Continued)

FOREIGN PATENT DOCUMENTS

CN 103006153 A 4/2013
CN 107260089 A 10/2017
(Continued)

OTHER PUBLICATIONS

International Patent Application No. PCT/US2021/023435, International Search Report and Written Opinion dated Jul. 6, 2021, 13 pages.

*Primary Examiner* — Don M Anderson
*Assistant Examiner* — Caleb Andrew Holizna
(74) *Attorney, Agent, or Firm* — Fredrikson & Byron, P.A.

(57) ABSTRACT

A floor cleaning system may include a docking station to which an autonomous floor cleaning machine can dock between cleaning operations. The docking station can provide power to the autonomous floor cleaning machine to recharge the batteries of the machine when not in use. The docking station may also supply fresh cleaning fluid to the floor cleaning machine and remove collected waste from the machine. In practice, the floor cleaning machine may itself become dirty over repeated use, such as when cleaning greasy floor surfaces. Accordingly, the docking station may include flushing orifices to clean the floor cleaning machine itself, such as with a degreasing composition.

9 Claims, 3 Drawing Sheets

(56) References Cited

U.S. PATENT DOCUMENTS

| | | | | |
|---|---|---|---|---|
| 2002/0185559 | A1* | 12/2002 | Grimes | E03C 1/266 241/101.2 |
| 2007/0016328 | A1* | 1/2007 | Ziegler | A47L 9/009 701/23 |
| 2007/0089260 | A1 | 4/2007 | Shinier et al. | |
| 2016/0331202 | A1 | 11/2016 | Arakawa | |
| 2016/0347599 | A1 | 12/2016 | Arakawa | |
| 2017/0164800 | A1 | 6/2017 | Arakawa | |
| 2018/0368646 | A1 | 12/2018 | Buehler et al. | |
| 2019/0069748 | A1 | 3/2019 | Blumhardt et al. | |
| 2019/0202064 | A1 | 7/2019 | Wolff et al. | |
| 2019/0254495 | A1 | 8/2019 | Zhang | |
| 2020/0077858 | A1* | 3/2020 | Zhang | A47L 11/4061 |
| 2021/0045612 | A1* | 2/2021 | Xie | A47L 11/4019 |

FOREIGN PATENT DOCUMENTS

| | | | |
|---|---|---|---|
| CN | 107951448 | A | 4/2018 |
| CN | 108403017 | A | 8/2018 |
| CN | 108720744 | A | 11/2018 |
| CN | 106264340 | B | 12/2018 |
| CN | 106725135 | B | 1/2019 |
| CN | 109394076 | A | 3/2019 |
| CN | 109528111 | A | 3/2019 |
| CN | 109662657 | A | 4/2019 |
| CN | 109998423 | A | 7/2019 |
| CN | 110051285 | A | 7/2019 |
| CN | 209404651 | U | 9/2019 |
| CN | 110367885 | A | 10/2019 |
| CN | 110464265 | A | 11/2019 |
| DE | 102010017258 | A1 | 12/2011 |
| DE | 102013103086 | A1 | 10/2014 |
| DE | 102014108217 | A1 | 12/2015 |
| DE | 202016104066 | U1 | 12/2017 |
| DE | 202016104067 | U1 | 12/2017 |
| DE | 202016104069 | U1 | 12/2017 |
| EP | 3400859 | A1 | 11/2018 |
| EP | 3542695 | A1 | 9/2019 |
| EP | 3284382 | B1 | 11/2019 |
| KR | 20070103248 | A | 10/2007 |
| KR | 100876705 | B1 | 12/2008 |
| KR | 100947362 | B1 | 3/2010 |
| KR | 20190053730 | A | 5/2019 |
| KR | 101985314 | B1 | 9/2019 |
| KR | 20190131385 | A | 11/2019 |
| WO | 2005055795 | A1 | 6/2005 |
| WO | 2008138767 | A1 | 11/2008 |
| WO | 2018107465 | A1 | 6/2018 |
| WO | 2018108144 | A1 | 6/2018 |
| WO | 2018162733 | A1 | 9/2018 |
| WO | 2019104692 | A1 | 6/2019 |

* cited by examiner

DOCKING STATION WITH UNDERCARRIAGE CLEANING FUNCTIONALITY FOR FLOOR CLEANING MACHINE

RELATED MATTERS

This application claims the benefit of U.S. Provisional Patent Application No. 62/993,031, filed Mar. 22, 2020, the contents of which are incorporated herein by reference.

TECHNICAL FIELD

This disclosure relates to cleaning systems and, more particularly, to docking stations for cleaning machines.

BACKGROUND

Cleaning machines are used extensively for cleaning flooring surfaces such as tile, stone, brick, wood, concrete, carpets and other common surfaces. Maintaining the cleanliness of these surfaces, especially in high volume areas in commercial, industrial, institutional and public buildings is an ongoing and time-consuming process. Automated robots and robotic devices are becoming more prevalent today to perform these types of continuous, time-consuming takes.

For example, autonomous floor cleaning devices can be used to automatically clean a defined floor surface without requiring operator intervention. The autonomous floor cleaning device can include an on-board power unit that is recharged at a base or docking station. The floor cleaning device can periodically dock at the docking station, for example, when on-board power is running low and/or between scheduled cleaning operations. As a result, the autonomous floor cleaning device may clean a floor surface many times over a period of days, weeks, or even months with limited or no human operator intervention. In practice, the quality of cleaning provided by the autonomous floor cleaning device may degrade if the device itself requires service, which may not be detected by a human operator during an extended period of autonomous operation.

SUMMARY

In general, this disclosure is directed to a floor cleaning system that includes a docking station to which a floor cleaning machine, such as an autonomous floor cleaning machine, can dock between cleaning operations. The docking station may provide power to the autonomous floor cleaning machine via a wired and/or wireless connection to recharge batteries carried by the machine. In addition, in some implementations, the docking station may supply fresh cleaning fluid to the floor cleaning machine and/or remove collected waste from the machine while docked at the docking station.

In practice, it has been observed that some cleaning environments result in the floor cleaning machine itself becoming dirty and fouled. For example, the floor cleaning machine may include a cleaning head, such as a rotating scrubber head and/or sweeping head, that contacts the floor surface being cleaning. The cleaning head can agitate the floor surface to help lift and remove soil from the floor surface during cleaning operation. The removed soil may be captured in a waste collection reservoir of the floor cleaning machine. However, a portion of the soil may adhere to the cleaning head itself (e.g., bristles and/or pads of the cleaning head). This soil can build-up on the cleaning head, reducing the cleaning effectiveness of the floor cleaning machine.

For example, in restaurants and other commercial environments, a floor cleaning machine may be used to clean a floor surface that has high olefinic content (e.g., grease). These organic soils may release from the floor surface being cleaned in response to the souring action of the cleaning head but then become retained on the cleaning head itself. Overtime, a thick, oily/waxy residue may buildup on the surface of the cleaning head, undermining the cleaning effectiveness of the floor cleaning machine.

In accordance with some examples of the present disclosure, the docking station for the floor cleaning machine can clean the floor cleaning device itself while docked at the docking station. For example, the docking station may include a platform over which the floor cleaning machine is at least partially positioned, when docked at the docking station. The docking station can also include one or more flushing orifices arranged to deliver a device cleaning fluid to the underside of the floor cleaning machine, such as one or more nozzles positioned to deliver a cleaning liquid to the cleaning head of the floor cleaning machine. The one or more nozzles may be stationary and/or may move relative to the floor cleaning machine while cleaning the machine. In some implementations, the one or more nozzles can clean an exterior surface (e.g., housing) of the floor cleaning machine in addition to cleaning an underside of the device. The docking station may or may not also have rotating and/or moving brushes to clean the cleaning head of the floor cleaning machine, an underside of the machine, and/or an exterior surface of the machine.

In any case, the docking station may be implemented to clean at least the cleaning head of the floor cleaning machine with a device cleaning fluid. The device cleaning fluid used to clean the floor cleaning machine may be the same cleaning fluid supplied for cleaning the floor surface. Alternatively, a device cleaning fluid having a different composition than that supplied for cleaning the floor surface. For example, where the cleaning head of the floor cleaning machine is expected to clean grease or other organic build-up, a degreasing composition may be used to clean and degrease the cleaning head while docked to the docking station.

In one example, a floor cleaning system is described that includes a floor cleaning machine and a docking station. The floor cleaning machine includes at least one drive wheel operable to drive the floor cleaning machine across a floor surface to be cleaned, a cleaning head being configured to clean the floor surface as the floor cleaning machine is driven across the floor surface by the at least one drive wheel, a cleaning fluid reservoir, and a waste fluid reservoir. The docking station is configured to interface with and allow the floor cleaning machine to dock therewith. The docking station includes a platform comprising a drain and at least one flushing orifice. The platform is arranged to receive the floor cleaning machine in a position in which at least a portion of an underside of the floor cleaning machine is positioned over the platform. The flushing orifice is arranged to deliver a device cleaning fluid to at least the cleaning head of the floor cleaning device.

The details of one or more examples are set forth in the accompanying drawings and the description below. Other features, objects, and advantages will be apparent from the description and drawings, and from the claims.

DETAILED DESCRIPTION

Figure 1:
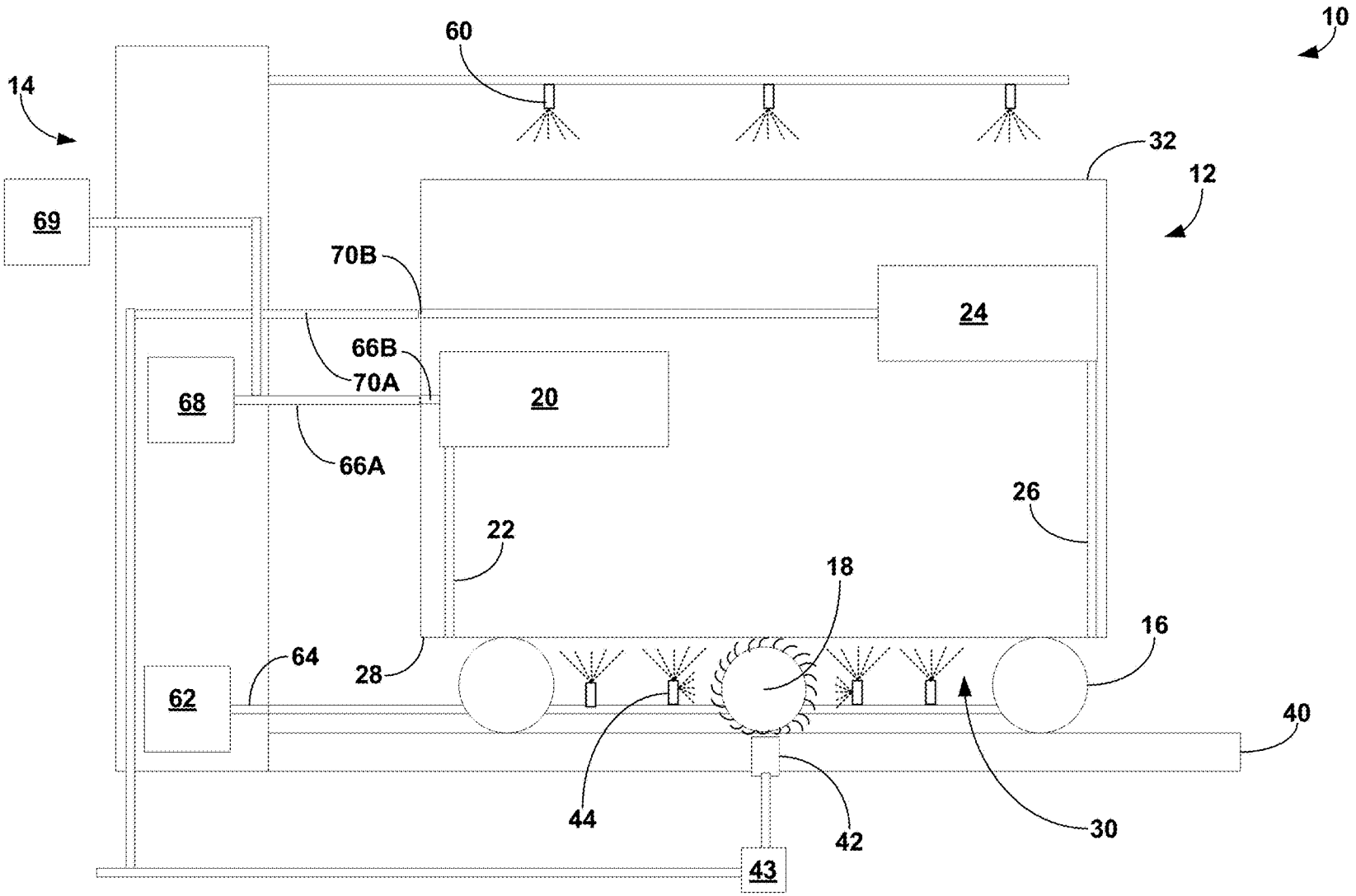
FIG. 1 is an illustration of an example floor cleaning system that includes a floor cleaning machine and a docking station.

This disclosure generally relates to docking stations for floor cleaning machines and related systems and techniques. In some examples, a docking station according to the disclosure includes one or more mechanical and/or electrical and/or fluid connections configured to interface with corresponding features and/or connections on a floor cleaning machine to be docked at the docking station. This can allow the floor cleaning machine to be serviced and supplied for continued operation.

For example, the docking station may include one or more mechanical interface features that interface with one or more corresponding features on the floor cleaning machine, when the floor cleaning machine is docked at the docking station. As another example, the docking station may include one or more electrical connection features that electrically connect with one or more corresponding electrical connection features on the floor cleaning machine, when the floor cleaning machine is docked at the docking station. This can allow batteries on the floor cleaning machine to be recharged upon docking and/or data communication to and/or from the floor cleaning machine. As still a further example, the docking station may include one or more fluid connection features that interface with corresponding fluid connection features on the floor cleaning machine, when the floor cleaning machine is docked at the docking station. For example, the docking station may include a fluid connection for establishing fluid communication with a cleaning fluid reservoir on the floor cleaning machine, allowing the cleaning fluid reservoir to be refilled upon docking. Additionally or alternatively, the docking station may include a fluid connection for establishing fluid communication with a waste fluid reservoir on the floor cleaning machine, allowing the waste fluid reservoir to be emptied upon docking.

In some implementations, the docking station is configured to clean the floor cleaning machine, when the floor cleaning machine is docked at the docking station. For example, the docking station may be configured to clean an underside of the floor cleaning machine and/or surfaces of the machine that interface with the floor surface being cleaned, when the floor cleaning machine is docked at the docking station. For example, the docking station may include one or more flushing nozzles that spay device cleaning fluid against an underside of the floor cleaning machine and/or cleaning brushes/pads of the machine. Additionally or alternatively, the docking station may be configured to clean an exterior surface of the floor cleaning machine, such as a housing of the machine that encloses the operational components of the machine.

By configuring the docking station to clean the floor cleaning machine, the docking station can help ensure that the floor cleaning machine provides effective floor surface cleaning during subsequent use. For example, the docking station can remove build-up soil on the cleaning head of the machine and/or prevent soil released from a floor surface during cleaning from building on the cleaning head. This can help ensure that the floor cleaning machine continues to achieve desired floor cleaning performance, which may otherwise deteriorate if the cleaning head of the floor cleaning machine itself becomes fouled.

While a docking station according to the disclosure can be beneficial for any types of floor cleaning machines and any types of operating environments, in some implementations, the docking station is used with an autonomous floor cleaning machine. An autonomous floor cleaning machine may be one operable to automatically clean a floor surface without requiring operator intervention. In other words, an operator need not stand-on, ride-on, push, or otherwise physically manipulate the floor cleaning device to cause the floor cleaning machine to perform a floor surface cleaning operation. Because the floor cleaning machine may clean a floor surface many times over a period of days, weeks, or even months with limited or no human operator intervention, a human operator may not detect when the floor cleaning machine itself becomes fouled and/or when the floor cleaning machine is not providing desired floor cleaning effectiveness. In these applications, providing a docking station that can clean the autonomous floor cleaning machine to correct or avoid issues associated with the floor cleaning machine becoming fouled may be beneficial.

FIG. 1 is an illustration of an example floor cleaning system 10 that includes a floor cleaning machine 12 and a docking station 14. Floor cleaning machine 12 is operable to move about a floor surface and clean the floor surface during movement. When requiring replenishment and/or floor cleaning is not needed, floor cleaning machine 12 may navigate to docking station 14 and dock at the docking station. In different configurations, floor cleaning machine 12 can mechanically and/or electrically and/or fluidly couple to docking station 14 to establish a docked position of the floor cleaning machine relative to the docking station.

In general, docking station 14 may be designed to work with a floor cleaning machine having any desired configuration and functional characteristics. Floor cleaning machine 12 may carry one or more cleaning heads capable of performing sweeping, scrubbing, burnishing, and/or other cleaning functionality. Sweeping generally refers to a dry operation involving removing dust and larger particles from a floor surface such as by dust mopping, brushing, vacuuming or blowing or the like so that loose soil particles and other materials are not present during scrubbing or burnishing operations where their presence could inhibit the cleaning or burnishing or cause a discoloration of the coating or other physical damage to the floor surface during the more aggressive scrubbing and burnishing operations. By contrast, scrubbing generally refers to a wet operation involving the application of water and/or cleaning fluid to a floor surface together with scrubbing the floor surface with mops, rotating pads or brushes or other cleaning tools. Burnishing is a process of relatively high-speed polishing of a floor surface, e.g., after scrubbing to provide a glossy, reflective surface.

In the example of FIG. 1, floor cleaning machine 12 is illustrated as having at least one drive wheel 16 operable to drive the floor cleaning machine across a floor surface to be cleaned and one or more cleaning heads 18 carried by the floor cleaning machine. Cleaning head 18 is configured to clean the floor surface as the floor cleaning device is driven across the floor surface by the at least one drive wheel. In some examples, floor cleaning machine 12 includes a cleaning fluid reservoir 20 that can supply cleaning fluid to a floor surface being cleaned and/or cleaning head 18 via a fluid delivery system 22 (e.g., piping, valve(s), spray nozzle(s)). Floor cleaning machine can also include a waste fluid reservoir 24 that recovers cleaning fluid dispensed on the floor surface (e.g., after scrubbing), other liquid present on the floor, and soil released from the floor surface. Floor cleaning machine 12 can have a fluid recovery system 26 (e.g., vacuum suction, squeeze, piping, valve(s)) for collecting fluid from the floor surface and conveying the collected fluid from the floor surface to waste fluid reservoir 24.

As briefly discussed above, the drive system of floor cleaning machine 12 can include one or more drive wheels 16 for driving the machine across a surface to be cleaned. The drive wheels can be operated by a common drive motor or individual drive motors coupled by a transmission, which may include a gear train assembly or another suitable transmission. In an autonomous configuration, the drive system can receive inputs from a controller for driving the machine across a floor, e.g., based on inputs from a navigation/mapping system and/or sensors. The drive wheels 16 can be driven in a forward or reverse direction in order to move the unit forwardly or rearwardly. Furthermore, the drive wheels can be operated simultaneously or individually in order to turn the unit in a desired direction.

Cleaning head 18 may include one or more brushes positions to contact the floor surface being cleaned during movement of floor cleaning machine 12. For example, cleaning head 18 may be implemented using two counter-rotating brushes, one or both of which is driven by a motor. The brushes may be positioned relative to one another such that the bristles of the brushes overlap. As another example, cleaning head 18 may include a brush which has an axis of rotation substantially parallel to the floor and substantially perpendicular to an axis running from the front to the rear of the cleaner. As still a further example, cleaning head 18 may include a vacuum orifice for suctioning debris from the floor surface being cleaned.

The number, type, and configuration of cleaning heads 18 on floor cleaning machine 12 (e.g., number, selection, and arrangement of bristles) may vary depending on the floor surface intended to be cleaned and/or types of soils expected to be cleaned on the floor surface. Example floor surfaces that may be cleaned using floor cleaning machine 12 include, but are not limited to, concrete, tile, carpet, wood, plastic, stone, vinyl, and the like.

In different examples, floor cleaning machine 12 can be powered by an on-board power source, such as batteries or an internal combustion engine, or powered through an electrical cord. Floor cleaning machine 12 may be a ride-on machine that includes a seat and controls for an operator. Alternatively, floor cleaning machine may be designed for use by an operator that walks behind the machine, or the machine may be configured to be towed behind a vehicle.

In still other examples, floor cleaning machine 12 may be implemented as an autonomous floor cleaning device operable without human control. When so configured, floor cleaning machine 12 may include one or more controllers controlling the overall operation of the machine. The controller may be configured (e.g., appropriately designed and programmed) to govern over various components of the machine, including to control the drive wheel 16, cleaning head 18, cleaning fluid distribution, and waste fluid recovery. For example, the controller may provide commands to operate the drive wheels to maneuver the machine in a desired direction and provide commands to initiate or cease operation of the cleaning head 18, cleaning fluid distribution, and/or waste fluid recovery.

In some examples, the controller is designed to implement a suitable behavior-based-robotics scheme to issue commands that cause the machine to navigate and clean a floor surface in an autonomous fashion. The controller as well as other components of the machine may be powered by a battery carried by the floor cleaning machine. For example, the controller may implement a behavior-based-robotics scheme based on feedback received from a plurality of sensors distributed about the floor cleaning machine and communicatively coupled to the controller. For instance, the floor cleaning machine may include an array of proximity sensors installed along the periphery of the machine. The proximity sensors may generate a signal responsive to the presence of potential obstacles that may appear in front of or beside the machine. In different examples, floor cleaning machine 12 may travel in a random or defined path during a floor cleaning operation. In some implementations, floor cleaning machine 12 maps an operating environment during a cleaning run, keeping track of traversed areas and untraversed areas and stores a position on the map at which the controller instructs the machine to return to docking station 14. In some implementations, floor cleaning machine 12 includes at least one vision-based sensor, such as a camera having a field of view, for guiding autonomous movement.

The various components of floor cleaning machine 12 can be carried by a chassis 28, such a base frame to which the components of the machine are directly or indirectly connected. Chassis 28 may define an underside 30 facing a floor surface to be cleaned, with the one or more cleaning heads 18 being positioned on and/or extending from the underside of the chassis. An external housing 32 formed of one or more pieces may cover the various internal components floor cleaning machine 12.

Independent of the specific configuration of floor cleaning machine 12, the machine may navigate to and dock at docking station 14. When floor cleaning machine 12 is an autonomous machine, the machine may use a variety of different navigation techniques to find and dock at docking station 14 (e.g., radio signals, dead reckoning, ultrasonic beams, infrared beams coupled with radio signals, etc.).

Docking station 14 may include a platform 40 that is defined by or positioned over a floor surface, allowing floor cleaning machine 12 to travel to a location where underside 30 is at least partially positioned over the platform. For example, in different implementations, an entirety of floor cleaning machine 12 or a lesser portion thereof may be positioned over platform 40, when the machine is docked at docking station 14. For example, platform 40 may be configured (e.g., sized and/or shaped) relative to floor cleaning machine 12 such that at least cleaning head 18 carried by the machine can be position over the platform. Floor cleaning machine 12 may be positioned over platform 40 such that an axis extending vertically upwardly from platform 40 intersects the floor cleaning machine.

Platform 40 may include one or more drains 42 that allow liquid flowing downwardly from floor cleaning machine 12 and landing on platform 40 to exit the platform. Platform 40 may or may not be sloped toward drain 42 to facilitate efficient drainage from the platform. In different implementations, platform 40 may be a dedicated structure or surface associated with docking station 14 or may be a multi-purpose floor surface area, such as a mop or bucket filling station with sidewalls extending upwardly from the platform. In this regard, it should be appreciated that platform 40 need not be elevated above a surrounding floor surface to function as a platform as described herein.

Although drain 42 is illustrated in FIG. 1 as being positioned below platform 40 to allow liquid and debris sprayed and/or falling off floor cleaning machine 12 during the cleaning process to flow out of the drain under the force of gravity, drain need not be positioned in such location. For example, platform 40 may be a solid surface that slopes to a collection location. A suction tubing line may draw the collected liquid from the collection location and discharge it to a separately located drain. Additionally or alternatively, docking station 14 may be configured to discharge to a drain of a waste sink, e.g., such as a waste sink in a back-of-house food service location. Other drain arrangements are possible.

In practice, comparatively large-sized debris may be captured in cleaning head 18 of floor cleaning machine 12 during floor cleaning operations. Examples of such debris includes food waste (e.g., French fries, hamburger pieces, pickles, lettuce), packaging waste (e.g., condiment packets, straw wrappers), and other ground refuse (e.g., leaves, napkins). These materials may become entrained in cleaning head 18 (e.g., captured between the bristles of a brush) during cleaning. The solid debris may be released from the cleaning head as the cleaning head is flushed with device cleaning liquid, e.g., causing the wetted debris to collect on platform 40 and/or flow toward drain 42. This may have a tendency to plug drain 42.

In such situations, docking station 14 may include a size reducing unit 43 positioned to receive material entering drain 42 of the platform and shear the material to reduce a size of the material. Size reducing unit 43 shear the material (e.g., by grinding the material) to cause comparatively large-sized debris to be reduced to a smaller size before passing further into drain 42 and/or through downstream discharge piping. Size reducing unit 43 may be implemented using a garbage disposal or other similarly configured device capable of receiving a stream containing liquid with entrained solid material. When used, size reducing unit 43 may receive material entering drain 42 either upstream or downstream of the initial drain opening.

In some examples, docking station 14 may include a housing that defines an enclosed cavity or receiving space into which floor cleaning machine 12 enters. For example, docking station 14 can have an opening on one side, which may or may not be closed by a movable door, that provides access to an enclosure into which floor cleaning machine 12 can enter for docking. In other examples, docking station 14 may not define an enclosed receiving space but instead be partially or fully open to the ambient environment.

Independent of the layout or housing configuration of docking station 14, the docking station may include at least one flow orifice 44 arranged to deliver a device cleaning fluid to floor cleaning machine 12. For example, flow orifice 44 may be arranged to deliver a cleaning fluid to an underside of floor cleaning machine 12, which may be an entirety of the underside of the floor cleaning machine or a subsection thereof. In some examples, flow orifice 44 may be arranged to deliver a cleaning fluid to at least the one or more (e.g., all) of the cleaning heads 18 of floor cleaning machine 12. Since cleaning head 18 of floor cleaning machine 12 is the feature that interfaces with the floor surface to be cleaned, cleaning at least this feature of the machine may be useful to help ensure effective continued cleaning operation.

In some examples, docking station 14 may have a single orifice through which cleaning fluid is delivered to clean floor cleaning machine 12. In other examples, docking station 14 may have a plurality of orifices (e.g., two, three, four, five, six, or more) through which cleaning fluid is delivered to clean floor sweeping machine. When configured with multiple orifices, docking station 14 may have one or more manifolds each defining a plurality of orifices 44 through which cleaning fluid is delivered to clean floor cleaning machine 12 (e.g., an underside of the floor cleaning machine). The one or more manifolds may be arranged relative to docking station 14 such that, when floor cleaning machine 12 is docked on the docking station, the orifices are appropriately positioned relative to the floor cleaning machine to deliver cleaning fluid to desired locations.

Figure 2:
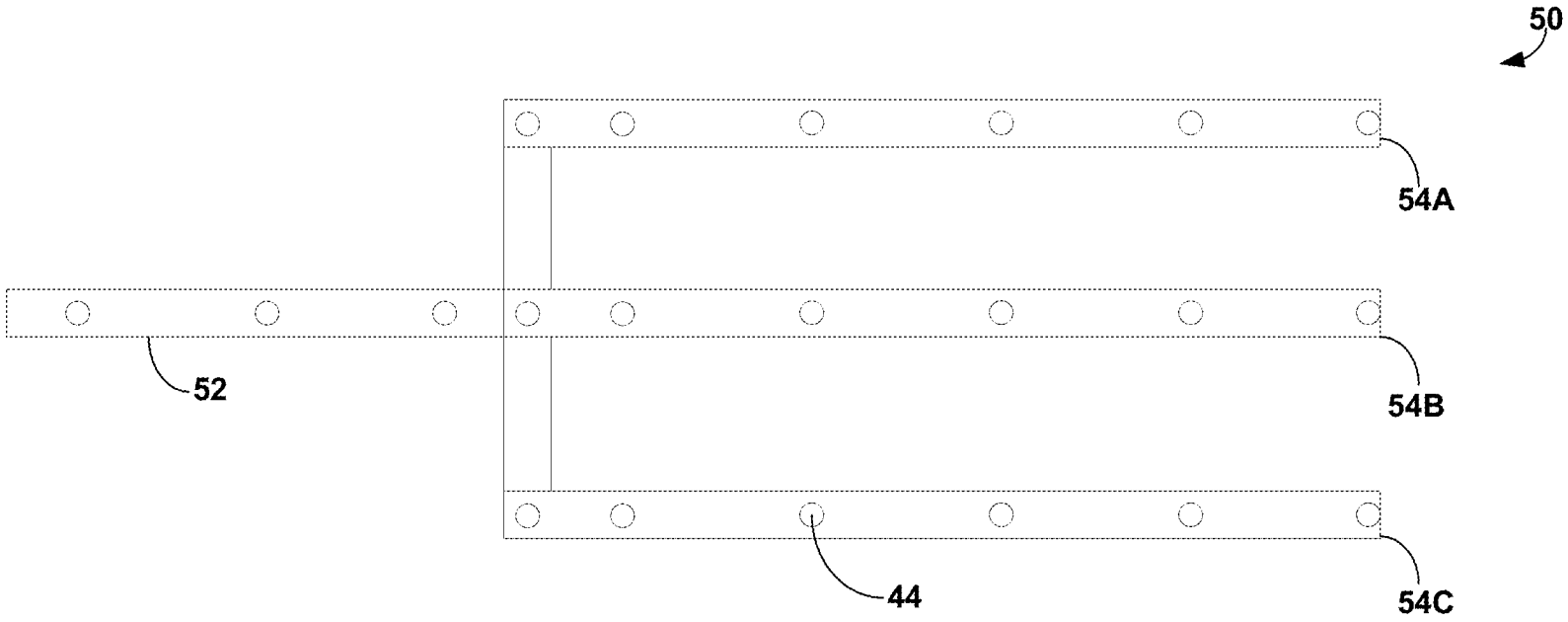
FIG. 2 is a top view of an example manifold that may be used with the example docking station of FIG. 1 to deliver device cleaning fluid to an underside of a floor cleaning machine.

FIG. 2 is a top view of an example manifold 50 that may be used to deliver device cleaning fluid to an underside of floor cleaning machine 12, when the machine is docked with docking station 14. In this example, manifold 50 has a main conduit 52 in fluid communication with a plurality of secondary conduits 54A-54C. A plurality of flushing orifices 44 are defined across manifold 50, each of which can deliver device cleaning fluid to floor cleaning machine 12 when positioned relative to manifold 50.

Each feature described as an orifice may be an opening through which liquid is delivered to clean floor cleaning machine 12. One or more (e.g., optionally all) of the flushing orifices may include a nozzle or turbulent flow system, which may generate a spray pattern and/or turbulent fluid stream directable against floor cleaning machine 12. Some or all of flushing orifices 44 may be fixedly positioned relative to platform 40 and floor cleaning machine 12 when docked. Additionally or alternatively, some or all of flushing orifices 44 may be configured to move relative floor cleaning machine 12, such as relative to underside 30 of the floor cleaning machine. For example, one or more orifices 44 may be on a movable gantry or other mobile component, allowing the orifice and liquid delivered therethrough to move relative to a remainder of docking station 14 and floor cleaning machine 12, when docked.

While the foregoing discussion of docking station 14 has focused on the docking station having one or more flushing orifices to deliver a cleaning fluid to an underside of floor cleaning machine 12, the docking station may be configured to clean exterior housing 32 of the floor cleaning machine 12 in addition to or in lieu of cleaning underside 30. For example, docking station 14 may include at least one external surface flushing orifice 60 positioned to clean some or all of external housing 32 of floor cleaning machine 12 (e.g., a top surface and/or sidewall surfaces of the machine).

To supply liquid for cleaning floor cleaning machine 12, docking station 14 may include a reservoir 62 that stores device cleaning fluid supplied to orifices 44 and/or 60. Device cleaning fluid may be stored in reservoir 62 in dilute, ready-to-use form, or may be stored in concentrated form that is diluted by docking station 14 prior to or concurrent with use. For example, device cleaning fluid may be stored in reservoir 62 in a concentrated liquid form or as a solid that is dissolved by a diluent. A fluid conduit 64 can directly or indirectly convey the device cleaning fluid from reservoir 62 to the one or more flushing orifices. Docking station 14 may be connected to a liquid supply network, in particular a water supply network, to receive water for performing various functions described of the docking station herein, such as diluting a concentrated device cleaning fluid.

Any type of cleaning liquid may be supplied to the flushing orifices 44, 60 of docking station 14 to clean floor cleaning machine 12. The liquid used to clean docking station 14 is generally referred to a device cleaning fluid in the present disclosure. In some examples, water without additional added chemicals may be used as a device cleaning fluid to flush floor cleaning machine 12. Additionally or alternatively, various chemical agents may be used to increase the effectiveness of the flushing and cleaning performed on by docking station. The cleaning agents used may be selected based on the types of soils expected to be encountered on floor cleaning machine 12 within the target operating environment. In some examples, the device cleaning fluid includes one or more surfactants to help remove soil from floor cleaning machine 12.

In one example, the device cleaning fluid used to clean floor cleaning machine 12 is or includes a degreasing composition. A degreasing composition may be, e.g., one specifically formulated remove fats and oils. The degreaser may include an alkali or alkaline earth metal hydroxide, for example, sodium hydroxide (NaOH) or caustic, e.g., in addition to various surfactants, solvents, and other additives. Cleaning floor cleaning machine 12 with a degreasing composition may be useful to remove residual fat and oil deposits from the machine, such as those that may be picked up by the cleaning machine when cleaning full and quick service restaurants (e.g., back of the house), as well in other operating environments.

In addition to being configured to clean floor cleaning machine 12, docking station 14 may interface with the machine to service the machine for subsequent operation. For example, docking station 14 may include a supply conduit 66A configured to fluidly connect with a corresponding connection 66B on floor cleaning machine 12, when the floor cleaning machine is docked to the docking station. Cleaning fluid can be supplied from docking station 14 to floor cleaning machine 12 via supply conduit 66A to refill the cleaning fluid reservoir 20 on the machine with a cleaning fluid. Floor cleaning machine 12 can subsequently dispense the cleaning fluid filled from reservoir 20 onto a floor surface being cleaned.

Docking station 14 can supply any desired type of cleaning fluid. In some examples, water without additional added chemicals may be used as the cleaning fluid supplied to floor cleaning machine 12. The water may or may not be electrically activated. Additionally or alternatively, various chemical agents may be used to increase the cleaning effectiveness of the cleaning fluid delivered by floor cleaning machine 12. The cleaning agents used may be selected based on the types of soils expected to be encountered on floor surface being cleaned by floor cleaning machine 12. In some examples, the cleaning fluid comprises a surfactant.

To supply cleaning fluid to floor cleaning machine 12, docking station 14 may include a cleaning fluid supply reservoir 68 that stores cleaning fluid supplied to the cleaning machine via fluid conduit 66A. Fluid may be stored in reservoir 68 in dilute, ready-to-use form, or may be stored in concentrated form that is diluted by docking station 14 prior to or concurrent with use. For example, cleaning fluid may be stored in reservoir 68 in a concentrated liquid form or as a solid that is dissolved by a diluent. Docking station 14 may be connected to a water supply network 69 to receive water for diluting the concentrated cleaning fluid.

Depending on the application, the cleaning fluid supplied to floor cleaning machine 12 for subsequently dispensing on a floor surface to be cleaned may be the same as or different than the device cleaning fluid used to clean the floor cleaning machine itself. When the same cleaning fluid is both utilized by floor cleaning machine 12 to help clean a floor surface and applied to clean the floor cleaning machine, docking station 14 may include a single reservoir containing the cleaning fluid (or concentrate thereof) to refill the machine upon docking and to supply to orifices 44, 60. In other example, the cleaning fluid supplied to floor cleaning machine 12 and subsequently dispensed on a floor surface being cleaned may be different than the device cleaning fluid used to clean the floor cleaning machine itself.

Docking station 14 may also interface with floor cleaning machine 12 to remove waste (e.g., solid waste, liquid waste) from the machine upon docking. For example, docking station 14 may include a discharge conduit 70A configured to fluidly connect with a corresponding connection 70B on floor cleaning machine 12, when the floor cleaning machine is docked to the docking station. Waste fluid can be withdrawn from reservoir 24 on floor cleaning machine 12 via discharge conduit 70A to partially or fully evacuate the waste fluid reservoir of waste fluid. A pump associated with either floor cleaning machine 12 or docking station 14 may be activated to provide a motive force to withdraw the waste fluid from waste fluid reservoir 24 and deliver the waste fluid to docking station 14. In some examples, the waste fluid received by docking station 14 is discharged to an associated drain for disposal.

In some examples, docking station 14 may flush waste fluid reservoir 24, fluid recovery system 26, and/or other fluid conduits or features associated with the waste fluid system of floor cleaning machine 12. Docking station 14 may introduce a flushing liquid (e.g., water, cleaning fluid, device cleaning fluid) into a fluid conduit associated with the waste fluid system to flush some or all of the system with the flushing liquid (e.g., in addition to or in lieu of evacuating the waste fluid system of waste fluid collected during floor cleaning operation).

Additionally or alternatively, docking station 14 may be configured to recharge one or more batteries carried by floor cleaning machine 12. For example, docking station 14 may be connected to an electrical supply network and configured to electrically connect with floor cleaning machine 12, when the floor cleaning machine is docked to the docking station. For example, a wired and/or wireless connection may be established between floor cleaning supplied from docking station 14 may recharge one or more batteries carried by floor cleaning machine.

In some examples, floor cleaning system 10 includes a detection device by which docking of floor cleaning machine 12 to docking station 14 is determinable. After a positive determination that floor cleaning machine 12 has docked to docking station 14, various actions may be performed on the machine. For example, different valves may be actuated and/or pump(s) activated to deliver device cleaning liquid to clean floor cleaning machine 12, to refill cleaning fluid reservoir 20, and/or empty waste fluid reservoir 24. Power may also be supplied from docking station 14 to recharge one or more batteries carried by floor cleaning machine 12. The detection device may be implemented using an electrical and/or mechanical detection device.

A docking station according to the disclosure may enhance the efficiency and cleaning effectiveness of a floor cleaning machine associated with the docking station. The docking station can service the floor cleaning machine for repeated cleaning of one or more target floor surfaces, including performing cleaning on the floor cleaning machine itself. The docking station can clean the floor cleaning machine each time the floor cleaning machine is docked at the docking station. Alternatively, the docking station may clean the floor cleaning machine some but not all of the times the floor cleaning machine is docked at the docking station.

While the foregoing discussion of system 10 has focused on a configuration of floor cleaning machine 12 and docking station 14 where the docking station includes at least one flushing orifice 44 arranged to deliver a device cleaning fluid to at least the cleaning head of the floor cleaning machine, other configurations are possible according to the disclosure. For example, in addition to or in lieu of configuring docking station 14 with flushing orifice 44, floor cleaning machine 12 may be designed with one or more flushing orifices 44. The one or more flushing orifices 44 can be used to flush at least a portion of floor cleaning machine 12 (e.g., a least a portion of underside 30 of the machine, at least cleaning head 18 of machine).

Figure 3:
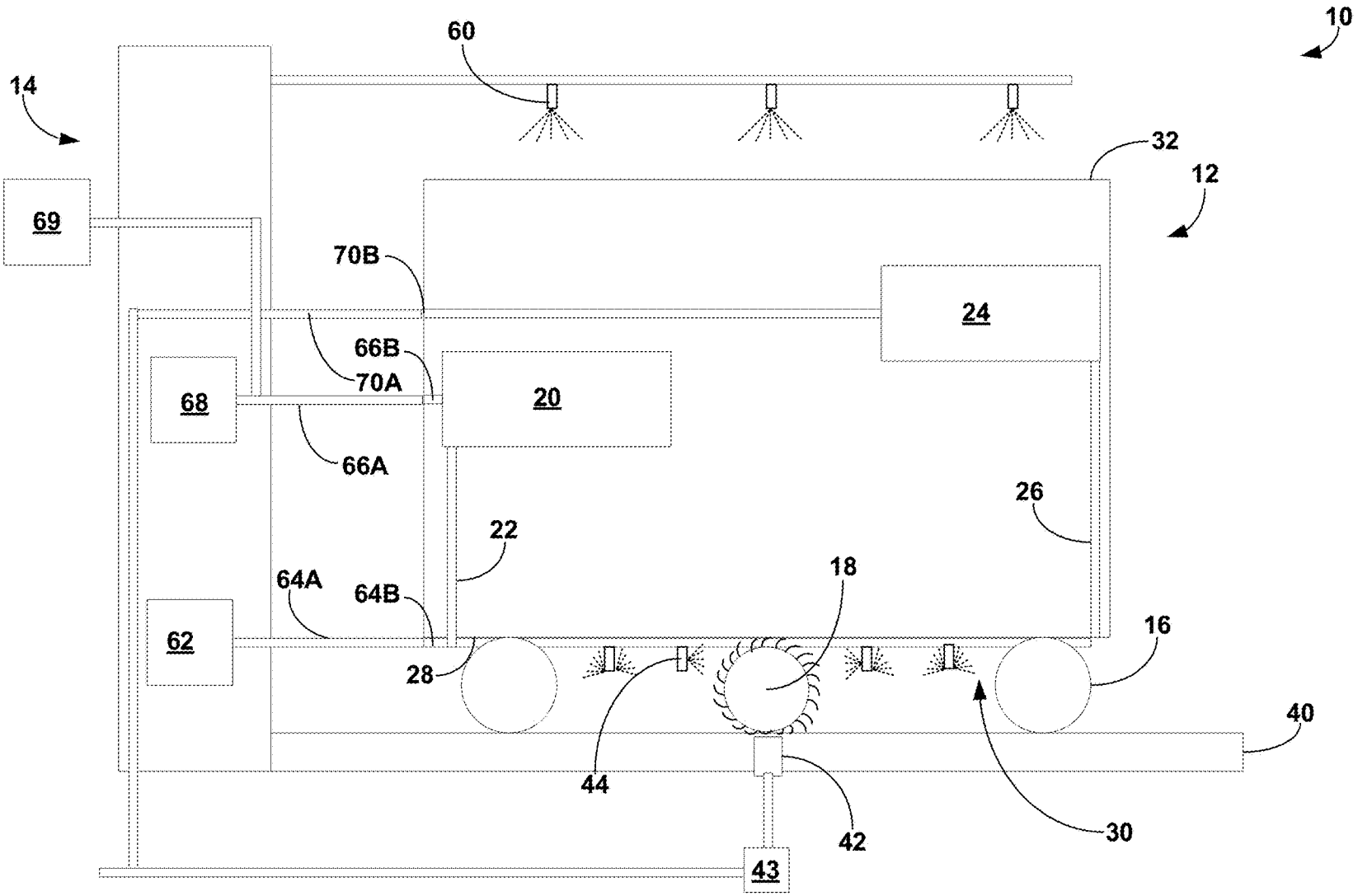
FIG. 3 is an illustration of another example configuration of an example floor cleaning system that includes a floor cleaning machine and a docking station.

FIG. 3 is an illustration of another example configuration of floor cleaning system 10 that includes a floor cleaning machine 12 and a docking station 14. Like reference numerals in FIG. 3 refer to like components discussed above with respect to FIGS. 1 and 2. In this example, floor cleaning machine 12 itself includes the one or more orifices 44 arranged to deliver a device cleaning fluid to clean at least a portion of floor cleaning machine, such as an underside of the machine and/or cleaning head 18. In FIG. 1, docking station 14 does not itself have a flushing orifice 44 for cleaning an underside of floor cleaning machine 12 although, in other examples, may also have one or more flushing orifices in addition to the one or more carried by floor cleaning machine 12.

In operation, floor cleaning machine 12 can dock at docking station 14. Docking station 14 may include a conduit 64A configured to fluidly connect with a corresponding connection 64B on floor cleaning machine 12. Device cleaning fluid can be supplied from docking station 14 to floor cleaning machine 12 via conduit 64A and conveyed out of the one or more orifices 44 for cleaning floor cleaning machine 12. A pump associated with floor cleaning machine and/or docking station 14 may pressurize the device cleaning fluid for discharge the device cleaning fluid under pressure out the one or more orifices and against the floor cleaning machine.

In another example, floor cleaning machine 12 may be cleaned with the cleaning fluid used by the floor cleaning machine to clean a floor surface in addition to or in lieu of being cleaned with a different device cleaning fluid. In these examples, cleaning fluid reservoir 20 of floor cleaning machine 12 and/or cleaning fluid supply reservoir 68 of docking station 14 may be placed in fluid communication with orifice 44 (e.g., via manifold 50 in FIG. 2). Cleaning fluid can then be supplied to the one or more orifices 44 to cleaning floor cleaning machine 12, e.g., from the onboard reservoir 20 of cleaning fluid with or without the reservoir being simultaneously refilled via cleaning fluid supply reservoir 68. As another example, cleaning fluid supply reservoir 68 of docking station 14 may simultaneously or sequentially supply cleaning fluid to both cleaning fluid reservoir 20 and orifice 44.

When floor cleaning machine 12 is configured with onboard orifice(s) 44, such as one or more spray nozzles or turbulent flow devices, the orifices can be arranged to direct flow in any desired direction or combinations of directions. The orifices may be arranged to spray upward against at least a portion of underside 30 of floor cleaning machine 12, downward, and/or sideways. In some examples, the one or more orifices may be retractable in floor cleaning machine 12. For example, the one or more orifices 44 may define spray nozzles that can retract up into an interior of floor cleaning machine 12 when not in use. When needed to clean floor cleaning machine 12, the nozzles may advance down out of their storage location. This configuration can move the orifices out of the free space under floor cleaning machine 12 when the orifices are not in use, e.g., allowing the floor cleaning machine to perform floor cleaning without having the orifices hinder operation or be subject to contact damage.

Various examples have been described. These and other examples are within the scope of the following claims.

The invention claimed is:

1. A floor cleaning system comprising:

a floor cleaning machine comprising:

at least one drive wheel operable to drive the floor cleaning machine across a floor surface to be cleaned;

a cleaning head being configured to clean the floor surface as the floor cleaning machine is driven across the floor surface by the at least one drive wheel, the cleaning head being provided on an underside of the floor cleaning machine;

a cleaning fluid reservoir;

a waste fluid reservoir; and an external housing covering components of the floor cleaning machine, the external housing comprising a top surface and a sidewall surface, the sidewall surface extending between the underside of the floor cleaning machine and the top surface of the external housing;

a docking station to which the floor cleaning machine is configured to dock, the docking station comprising:

a platform comprising a drain, the platform being arranged to receive the floor cleaning machine in a position in which at least a portion of an underside of the floor cleaning machine is positioned over the platform;

at least one flushing orifice arranged to deliver a device cleaning fluid to at least the cleaning head of the floor cleaning machine; and at least one external surface flushing orifice positioned to deliver the device cleaning fluid to the external housing of the floor cleaning machine.

2. The system of claim 1, wherein the floor cleaning machine is an autonomous floor cleaning machine operable without human control.

3. The system of claim 1, wherein the docking station comprises:

a reservoir configured to store the device cleaning fluid or a concentrated form thereof; and a device cleaning fluid conduit configured to directly or indirectly convey the device cleaning fluid from the reservoir to the at least one flushing orifice.

4. The system of claim 1, wherein the at least one flushing orifice comprises a manifold defining a plurality of flushing orifices.

5. The system of claim 1, wherein the at least one flushing orifice is fixedly positioned relative to the platform.

6. The system of claim 1, wherein the at least one flushing orifice is configured to move relative to the underside of the floor cleaning machine.

7. The system of claim 1, wherein the docking station further comprises:

at least one supply conduit configured to fluidly connect with the cleaning fluid reservoir on the floor cleaning machine, when the floor cleaning machine is docked to the docking station, to refill the cleaning fluid reservoir with a cleaning fluid; and at least one discharge conduit configured to fluidly connect with the waste fluid reservoir on the floor cleaning machine, when the floor cleaning machine is docked to the docking station, to evacuate the waste fluid reservoir of a waste fluid.

8. The system of claim 1, wherein the docking station further comprises an electrical supply configured to electrically connect with the floor cleaning machine, when the floor cleaning machine is docked to the docking station, to recharge a battery carried by the floor cleaning machine.

9. The system of claim 1, wherein the docking station further comprises a size reducing unit positioned to receive material entering the drain of the platform and shear the material to reduce a size of the material.

* * * * *